United States Patent [19]

Stern et al.

[11] Patent Number: 4,745,377

[45] Date of Patent: May 17, 1988

[54] MICROSTRIP TO DIELECTRIC WAVEGUIDE TRANSITION

[75] Inventors: Richard A. Stern, Allenwood; Richard W. Babbitt, Fairhaven, both of N.J.

[73] Assignee: The United States of America as represented by the Secretary of the Army, Washington, D.C.

[21] Appl. No.: 59,347

[22] Filed: Jun. 8, 1987

[51] Int. Cl.[4] ..... H01P 5/10

[52] U.S. Cl. ..... 333/26; 333/34

[58] Field of Search ..... 333/21 R, 26, 34, 246, 333/254, 260

[56] References Cited

U.S. PATENT DOCUMENTS

| | | | |
|---|---|---|---|
| 2,825,876 | 3/1958 | Le Vine et al. | 333/34 |
| 2,979,676 | 4/1961 | Rueger | 333/34 |
| 4,716,387 | 12/1987 | Igarashi | 333/26 |

FOREIGN PATENT DOCUMENTS

| | | | |
|---|---|---|---|
| 675496 | 7/1979 | U.S.S.R. | 333/26 |

*Primary Examiner*—Paul Gensler

*Attorney, Agent, or Firm*—Sheldon Kanars; Robert A. Maikis

[57] ABSTRACT

A microstrip to dielectric waveguide transition is provided comprising a length of rectangular dielectric waveguide which has one end tapered in such a manner that the height of the waveguide top surface above the waveguide bottom surface decreases linearly from full height to zero height at the tapered end of the length of waveguide. The bottom surface of the waveguide length is mounted on the top surface of a planar microstrip dielectric substrate having an electrically conductive metallic ground plane on the bottom substrate surface and a length of microstrip conductor on the top substrate surface aligned with the waveguide length and abutting the tapered end of the waveguide length. A second length of microstrip conductor is mounted on the tapered portion and part of the untapered portion of the top surface of the waveguide length and is electrically connected to the first microstrip conductor at the tapered end of the waveguide length. The dielectric constant of the microstrip substrate should be no greater than the dielectric constant of the dielectric waveguide length and preferably should be much less.

6 Claims, 1 Drawing Sheet

MICROSTRIP TO DIELECTRIC WAVEGUIDE TRANSITION

STATEMENT OF GOVERNMENT RIGHTS

The invention described herein may be manufactured, used and licensed by or for the Government for governmental purposes without the payment to us of any royalties thereon.

BACKGROUND OF THE INVENTION

1. Field of the Invention

This invention relates to microstrip transmission lines and dielectric waveguides operating in the millimeter wave region of the frequency spectrum and more particularly to a transition for providing a low loss, broad band interconnection between such microstrip transmission lines and dielectric waveguides.

2. Description of the Prior Art

Planar type circuitry using microstrip is widely used in millimeter wave frequency applications because it permits the design of equipment having extremely small size and low weight which is desirable for many items of military and commercial equipment such as radar systems, for example. Unfortunately, planar type circuitry is inconvenient or not available with presently known technology for performing many functions such as the functions performed by phase shifters and antennas, for example. These functions are usually performed in millimeter wave frequency applications by equipment utilizing dielectric waveguide such as ferrite rod phase shifters and dielectric waveguide antennas, for example. In order to connect the microstrip transmission line of the planar circuitry to the solid dielectric waveguide for such applications, resort is usually had to a section of hollow, metallic waveguide. The end of the section of hollow, metallic waveguide which is to be coupled to the microstrip transmission line is usually provided with a metal ridge waveguide of the type described in an article entitled "Straightforward Approach Produces Broadband Transitions" by D. R. Singh and C. R. Seashore which appeared in the September, 1984 issue of the "Microwaves & RF Magazine". The other end of the section of hollow, metallic waveguide which is coupled to the dielectric waveguide is provided with impedance transformer means which matches the impedance of the metal waveguide to the impedance of the dielectric waveguide. As is well known in the art, the impedance transformer may comprise a section of the dielectric waveguide which projects a short distance into the hollow, metallic waveguide and which is tapered. It is apparent that this transition arrangement involves not only the microstrip to dielectric waveguide loss but also the microstrip to metallic waveguide guide transition loss, the metallic waveguide loss and the metallic waveguide to dielectric waveguide transition loss. Additionally, the transition equipment is relatively complex to fabricate and adds to the size and weight of the overall equipment.

SUMMARY OF THE INVENTION

It is an object of this invention to provide a microstrip to dielectric waveguide transition of simple construction which readily lends itself to the fabrication of compact and light weight millimeter wave equipment.

It is a further object of this invention to provide a microstrip to dielectric waveguide transition which eliminates the need for additional intermediate transitions such as metal waveguide transitions, for example, between the microstrip and the dielectric waveguide.

It is a still further object of this invention to provide a microstrip to dielectric waveguide transition which provides a low insertion loss and a broadband interconnection between the microstrip and the dielectric waveguide.

Briefly, the microstrip to dielectric waveguide transition of the invention comprises a length of microstrip transmission line dielectric substrate having top and bottom parallel surfaces, first electrically conductive microstrip conductor means mounted on the top surface of the substrate and extending over only a portion of the total length of the substrate so that the remaining portion of the substrate total length is not occupied by the conductor means, and an electrically conductive ground plane mounted on the bottom surface of the substrate. A length of dielectric waveguide having a rectangular cross-sectional area and top and bottom surfaces is mounted on the substrate with the bottom surface of the waveguide abutting the top surface of the substrate. The length of waveguide is aligned with the first microstrip conductor means and is disposed in the remaining portion of the substrate total length so that one end of the waveguide length abuts an end of the first microstrip conductor means. The top surface of the waveguide length is tapered such that the height of the waveguide top surface above the waveguide bottom surface decreases linearly from full height at a first point on the waveguide top surface which is spaced a distance away from the said one end of the waveguide length to zero height at said one end of the waveguide length. Second electrically conductive microstrip conductor means is electrically connected to the first microstrip conductor means and mounted on the top surface of the waveguide length. The second microstrip conductor means extends between the said one end of the waveguide length and a second point of full waveguide height on the waveguide top surface which is a short distance beyond the first point of full waveguide height.

The nature of the invention and other objects and additional advantages thereof will be more readily understood by those skilled in the art after consideration of the following detailed description taken in conjunction with the accompanying drawings.

DESCRIPTION OF THE PREFERRED EMBODIMENT OF THE INVENTION

Figure 1:
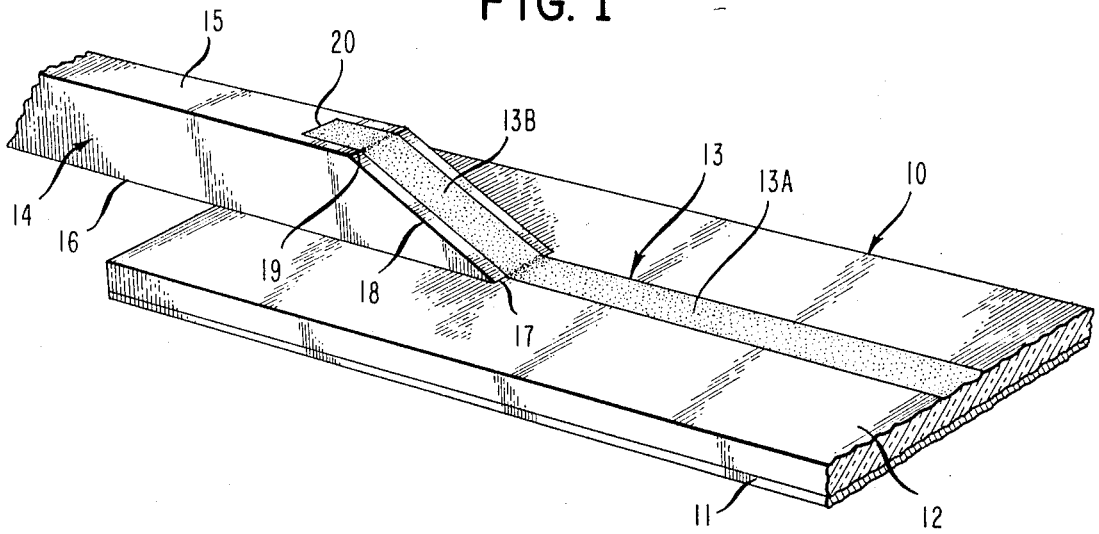
FIG. 1 is a perspective view of the microstrip to dielectric waveguide transition of the invention.

Referring now to FIG. 1 of the drawings, there is shown a microstrip to dielectric waveguide transition constructed in accordance with the teachings of the present invention comprising a length of microstrip transmission line dielectric substrate, indicated generally as 10, which has top and bottom parallel surfaces. The microstrip substrate 10 is fabricated of a dielectric material which exhibits a low loss characteristic at millimeter wave frequencies and which may have a dielectric constant ranging from about 2.2 to 16. The most commonly used material, however, is duroid which has a dielectric constant of 2.2. The thickness of the duroid substrate is usually about 0.010 inches. A ground plane 11 which is fabricated of a metal such as copper or silver, for example, is mounted on the bottom surface of the substrate 10 and covers that entire surface.

The substrate 10 has a top surface 12 on which is mounted a first part 13A of a length of microstrip conductor, indicated generally as 13. The microstrip conductor is fabricated of a metal having a good electrical conductivity such as copper or silver, for example. It will be noted that the part 13A of the conductor extends over only a portion of the total length of the substrate so that the remaining portion of the substrate total length is not occupied by the conductor. As thus far described, the substrate 10, the ground plane 11 and the microstrip conductor 13A form a conventional and well known microstrip transmission line which is used extensively in planar circuitry and which readily lends itself to millimeter wave frequency applications.

The transition of the invention also includes a length of dielectric waveguide, indicated generally as 14, which has a rectangular cross-sectional area and a top surface 15 and a bottom surface 16. The rectangular dielectric waveguide is also widely used as a transmission line in millimeter wave frequency applications and has also been used with well-known structural modifications to provide antenna and phase shifting functions in this area of the frequency spectrum. However, the height of a typical rectangular dielectric waveguide would be about 0.070 inches for such applications. Again, the solid rectangular waveguide is fabricated of a material having a low loss in the frequency region of interest and may have a dielectric constant ranging from 4 to 16. For many millimeter wave frequency applications, however, the dielectric material employed in the waveguide is magnesium titanate which has a dielectric constant of 13.

The length 14 of dielectric waveguide is mounted on the substrate 10 with the bottom surface 16 of the waveguide abutting the top surface 12 of the substrate and is aligned with the microstrip conductor part 13A. The length of waveguide is disposed in the remaining portion of the substrate total length which is not occupied by the conductor part 13A so that one end 17 of the waveguide length abuts the end of the part 13A of the microstrip conductor 13. The top surface 15 of the waveguide length 14 is tapered at 18 such that the height of the waveguide top surface 15 above the waveguide bottom surface 16 decreases linearly from the full height of the waveguide at a first point 19 (at which the taper begins) which is spaced a distance away from the end 17 of the waveguide length to zero height at the end 17 of the waveguide length. Accordingly, the tapered portion of the top surface 15 of the waveguide length is a plane surface so that the end 17 of the waveguide length is a straight line edge abutting the top surface 12 of the substrate 10.

The length of microstrip conductor 13 has a second part 13B which is mounted on the top surface 15 of the waveguide length 14. Microstrip conductor part 13B extends between the end 17 of the waveguide length 14 and a second point 20 of full waveguide height on the waveguide top surface which is a short distance beyond the first point 19 of full waveguide height so that this part of the microstrip conductor extends over the entire tapered portion of the waveguide top surface 15 and also extends a short distance onto the remaining untapered portion of the top surface 15.

By virtue of the foregoing arrangement, the tapered portion of the top surface 15 of the dielectric waveguide 14 functions as a "ramp" to effectively bridge the height difference between the top surface 12 of the substrate 10 and the untapered portion of the top surface 15 of the waveguide so that the signal carried by the microstrip transmission line is transferred to the dielectric waveguide transmission line. Quite unexpectedly, this transition is accomplished with only a minimal change in impedance of the overall transmission line which thereby eliminates the need for sophisticated transformers and other impedance matching techniques. The minimal change in impedance is unexpected because as the microstrip conductor 13B proceeds up the ramp, the overall thickness of the dielectric material (the thickness of the dielectric substrate plus the height of the top surface of the length of dielectric waveguide above the waveguide bottom surface) increases, so that the impedance of the transmission line will increase. However, since the dielectric constant of the microstrip substrate 10 is usually much less than the dielectric constant of the dielectric waveguide 14, the overall dielectric constant of the dielectric material (the dielectric constant of the microstrip substrate material and the dielectric constant of the waveguide material) is also increasing which thereby causes the transmission line impedance to decrease. Accordingly, since both of these effects are taking place simultaneously, there is relatively little change in impedance as the microstrip conductor 13 progresses up the tapered portion of the top surface 15 of the dielectric waveguide. When the microstrip conductor 13 reaches the full height portion of the dielectric waveguide top surface, the transmitted wave energy is captured by the high dielectric constant of the dielectric waveguide material and the use of the microstrip conductor 13 and the ground plane 11 is no longer needed. It has been found, however, that to insure complete capture of the transmitted signal by the dielectric waveguide, the part 13B of the dielectric conductor should extend somewhat beyond the first point of full waveguide height 19 (at which the downward taper begins) to the second point of full waveguide height 20. Although the microstrip to dielectric waveguide transition of the invention will operate when the dielectric constant of the microstrip substrate is approximately the same as the dielectric constant of the waveguide material, albeit with an increase in line impedance, the dielectric constant of the microstrip substrate should preferably be much less than the dielectric constant of the dielectric waveguide material.

Figure 2:
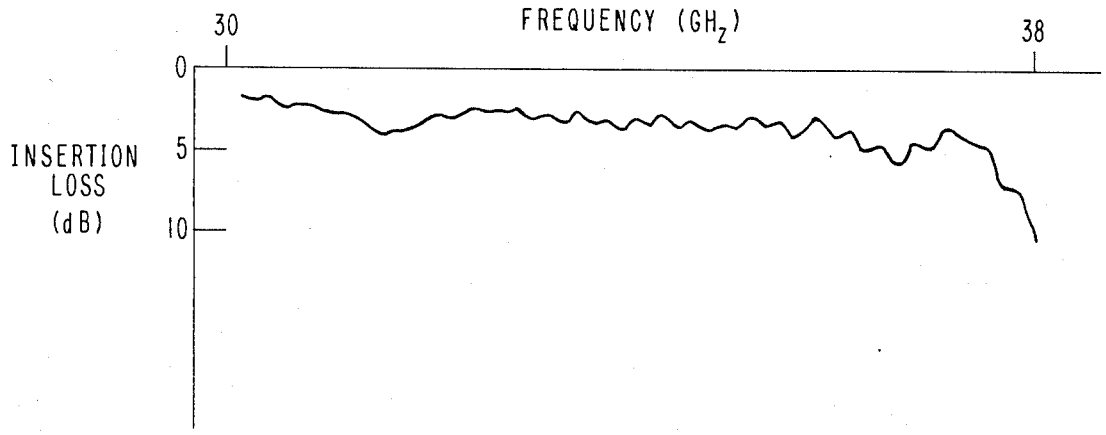
FIG. 2 is a graph showing insertion loss as a function of frequency over a selected frequency range for the microstrip to dielectric waveguide transition of FIG. 1.

It is apparent that the microstrip to dielectric waveguide transition of the invention eliminates the need for not only impedance matching devices and similar techniques but also eliminates the insertion losses produced by the intermediate microstrip to hollow, metallic waveguide and hollow, metallic waveguide to dielectric waveguide transitions employed in the prior art arrangements. FIG. 2 of the drawings is a graph showing insertion loss as a function of frequency in the 30 GHz to 38 GHz frequency region for testing a microstrip to dielectric waveguide transition in which the microstrip substrate was fabricated of duroid and the dielectric waveguide was fabricated of magnesium titanate. Since most millimeter wave test equipment has input and output ports adapted to receive hollow, metal waveguide, the test setup necessarily included a metal waveguide to microstrip transition and a dielectric waveguide to hollow, metal waveguide transition. Accordingly, although the nominal loss indicated in the graph of FIG. 2 is shown to be 3 dB, this 3 dB loss includes not only the insertion loss of the microstrip to dielectric waveguide transition of the invention but also the insertion losses of the metal waveguide, the dielectric waveguide, the microstrip, the metal waveguide to microstrip transition and the dielectric waveguide to metal waveguide transition as well. Since most of the aforementioned losses are well known, it is safe to say that the actual loss of the microstrip to dielectric waveguide transition of the invention would be approximately one-third of the 3 dB loss or 1 dB. It appears likely that insertion losses as low as 0.5 dB may be achieved when a more accurately fabricated production model transition is substituted for the initial laboratory transition employed in the test.

Figure 3:
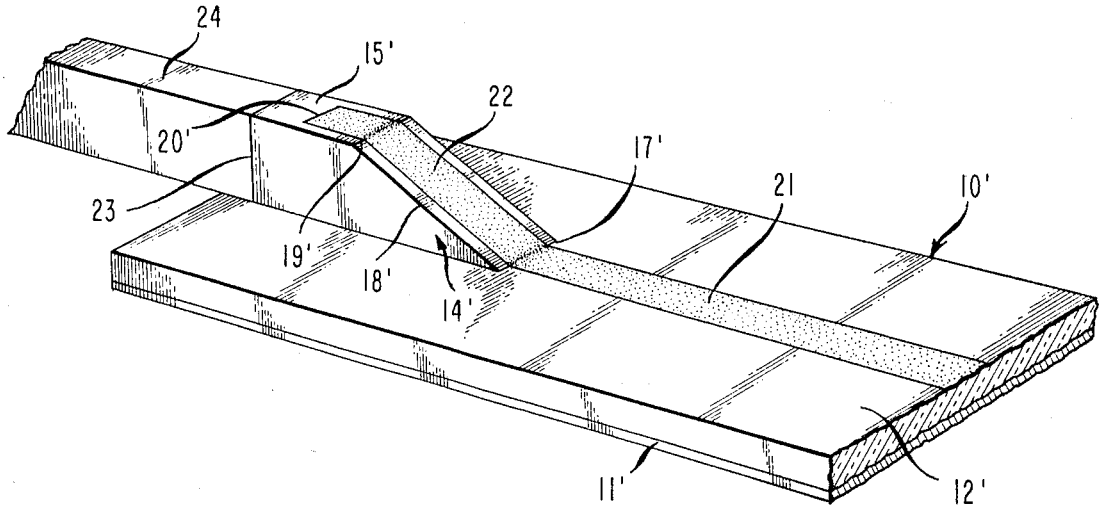
FIG. 3 is a perspective view of a microstrip to dielectric waveguide transition constructed in accordance with the teachings of the invention showing how certain modifications may be made in the construction of the transition of FIG. 1.

FIG. 3 of the drawings shows a microstrip to dielectric waveguide transition constructed in accordance with the teachings of the invention in which the single, integral length of microstrip conductor of FIG. 1 is replaced by two separate lengths of microstrip conductor and the dielectric waveguide is truncated a short distance beyond the end of the microstrip conductor. In describing this arrangement, reference numerals with a prime notation will be employed to designate elements which are the same as or substantially the same as the correspondingly numbered elements in the arrangement shown in FIG. 1 of the drawings. As seen in FIG. 3, the portion of the microstrip conductor which is on the surface 12' of the microstrip substrate 10' is fabricated of a single length 21 of electrically conductive metal and the portion of the microstrip conductor which is disposed on the tapered portion and part of the untapered portion of the top surface 15' of the dielectric waveguide 14' is fabricated of a separate length 22 of such electrically conductive material. The two lengths 21 and 22 may be electrically connected together by any convenient means such as soldering, for example, at the end 17' of the waveguide length 14'.

The length of the dielectric waveguide 14 in FIG. 1 was unspecified to indicate that the tapered transition portion of the waveguide could be an integral part of whatever length of waveguide was employed as the dielectric waveguide transmission line in the particular application in which the transition was employed so that a monolithic structure would result. If desired, however, as shown in FIG. 3, the length of waveguide 14' could be truncated so that the other end 23 of the length of dielectric waveguide 14' would be only a short distance beyond the second point 20' of full waveguide height on the top surface of the waveguide length at which the microstrip conductor 22 ends. The end 23 of the relatively short waveguide length 14' could then be coupled to a second, longer length 24 of dielectric waveguide transmission line by well known prior art methods such as cementing with a low loss, epoxy cement for example. Although this arrangement introduces the losses inherent in a butt joint, it offers some degree of production flexibility and permits use of the tapered transition portion of the waveguide as a separate element which may be advantageous for some applications.

It is believed apparent that many changes could be made in the construction and described uses of the foregoing microstrip to dielectric waveguide transition and many seemingly different embodiments of the invention could be constructed without departing from the scope thereof. Accordingly, it is intended that all matter contained in the above description or shown in the accompanying drawings shall be interpreted as illustrative and not in a limiting sense.

What is claimed is:

1. A microstrip to dielectric waveguide transition comprising a length of microstrip transmission line dielectric substrate having top and bottom parallel surfaces;

first electrically conductive microstrip conductor means mounted on the top surface of said substrate and extending over only a portion of the total length of the substrate so that the remaining portion of said substrate total length is not occupied by said conductor means;

an electrically conductive ground plane mounted on the bottom surface of said substrate;

a length of dielectric waveguide having a rectangular cross-sectional area and top and bottom surfaces mounted on said substrate with the bottom surface of the waveguide abutting the top surface of the substrate, said length of waveguide being aligned with said first microstrip conductor means and being disposed in said remaining portion of said substrate total length so that one end of said waveguide length abuts an end of said first microstrip conductor means, the top surface of said waveguide length being tapered such that the height of the waveguide top surface above the waveguide bottom surface decreases linearly from full height at a first point on said waveguide top surface which is spaced a distance away from said one end of said waveguide length to zero height at said one end of said waveguide length; and second electrically conductive microstrip conductor means electrically connected to said first microstrip conductor means and mounted on the top surface of said waveguide length, said second microstrip conductor means extending between said one end of said waveguide length and a second point of full waveguide height on said waveguide top surface which is a short distance beyond said first point of full waveguide height.

2. A microstrip to dielectric waveguide transition as claimed in claim 1 wherein said first electrically conductive microstrip conductor means and said second electrically conductive microstrip conductor means each comprise a separate microstrip conductor, and said separate microstrip conductors are electrically interconnected at said one end of said length of dielectric waveguide.

3. A microstrip to dielectric waveguide transition as claimed in claim 1 wherein said first electrically conductive microstrip conductor means and said second electrically conductive microstrip conductor means together comprise a single length of microstrip conductor.

4. A microstrip to dielectric waveguide transition as claimed in claim 1 wherein the other end of said length of dielectric waveguide is a short distance beyond said second point of full waveguide height on said waveguide top surface, and said other end of said length of dielectric waveguide is adapted to be coupled to a second length of dielectric waveguide.

5. A microstrip to dielectric waveguide transition as claimed in claim 1 wherein the dielectric constant of said microstrip transmission line dielectric substrate is no greater than the dielectric constant of said length of dielectric waveguide.

6. A microstrip to dielectric waveguide transition as claimed in claim 1 wherein the dielectric constant of said microstrip transmission line dielectric substrate is much less than the dielectric constant of said length of dielectric waveguide.

* * * * *